US005389030A

United States Patent [19]

Chapkis

[11] Patent Number: 5,389,030

[45] Date of Patent: Feb. 14, 1995

[54] INFLATABLE NOVELTY DEVICE

[76] Inventor: Stephen Chapkis, 30235 Via Victoria, Rancho Palos Verdes, Calif. 90274

[21] Appl. No.: 175,287

[22] Filed: Dec. 29, 1993

[51] Int. Cl.[6] ..... A63H 5/00; A63H 3/06; G09F 19/08; G09F 27/00

[52] U.S. Cl. ..... 446/397; 446/74; 446/221; 446/267; 472/51; 472/54; 40/412; 40/455

[58] Field of Search ..... 47/26 C, 79 C, 48.5 CR, 47/DIG. 14; 40/412, 477, 439, 455; 472/51, 54, 56; 446/397, 404, 71, 74, 76, 81, 181, 220, 221, 484, 485, 267

[56] References Cited

U.S. PATENT DOCUMENTS

| | | | |
|---|---|---|---|
| D. 101,788 | 11/1936 | Miltenberger . | |
| D. 193,155 | 7/1962 | Goldman et al. . | |
| D. 213,837 | 4/1969 | Davis . | |
| D. 230,482 | 2/1974 | Levey . | |
| D. 234,432 | 3/1975 | Boganowski . | |
| D. 311,560 | 10/1990 | Satoh et al. . | |
| D. 327,232 | 6/1992 | Winn . | |
| 4,020,417 | 4/1977 | Brehob et al. | 47/79 CR X |
| 4,347,683 | 9/1982 | Maxim | 446/267 |
| 4,476,648 | 10/1984 | Maxim | 446/462 X |
| 4,781,645 | 11/1988 | Kato | 446/221 X |
| 4,857,029 | 8/1989 | Dierick et al. | 446/220 |
| 4,920,674 | 5/1990 | Shaeffer | 40/412 |
| 4,950,460 | 8/1990 | Goodwin et al. | 422/239 |
| 5,020,261 | 6/1991 | Lishman | 47/79 C |
| 5,020,275 | 6/1991 | Bednarzik | 47/79 C |
| 5,083,771 | 1/1992 | Tyner | 40/412 X |
| 5,094,644 | 3/1992 | Kelley | 446/305 |

FOREIGN PATENT DOCUMENTS

| | | | |
|---|---|---|---|
| 2230200 | 10/1990 | United Kingdom | 446/305 |

*Primary Examiner*—Robert A. Hafer
*Assistant Examiner*—D. N. Muir
*Attorney, Agent, or Firm*—Merchant, Gould, Smith, Edell, Welter & Schmidt

[57] ABSTRACT

A novelty device includes an inflatable element fixed to a nipple which is normally covered. Adding fluid to a chamber which includes a fluid-reactive element causes a pressure increase to be imparted to the inflated element which then expands under the action of the pressure. Normally the nipple and the inflatable element are covered so as to be hidden from view prior to the addition of a fluid.

25 Claims, 2 Drawing Sheets

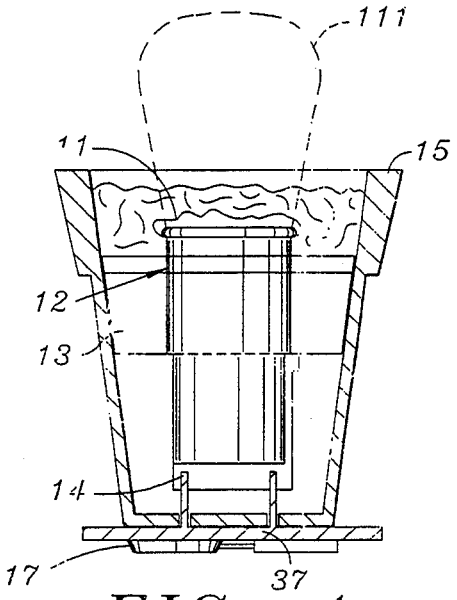
FIG. 4
FIG. 5
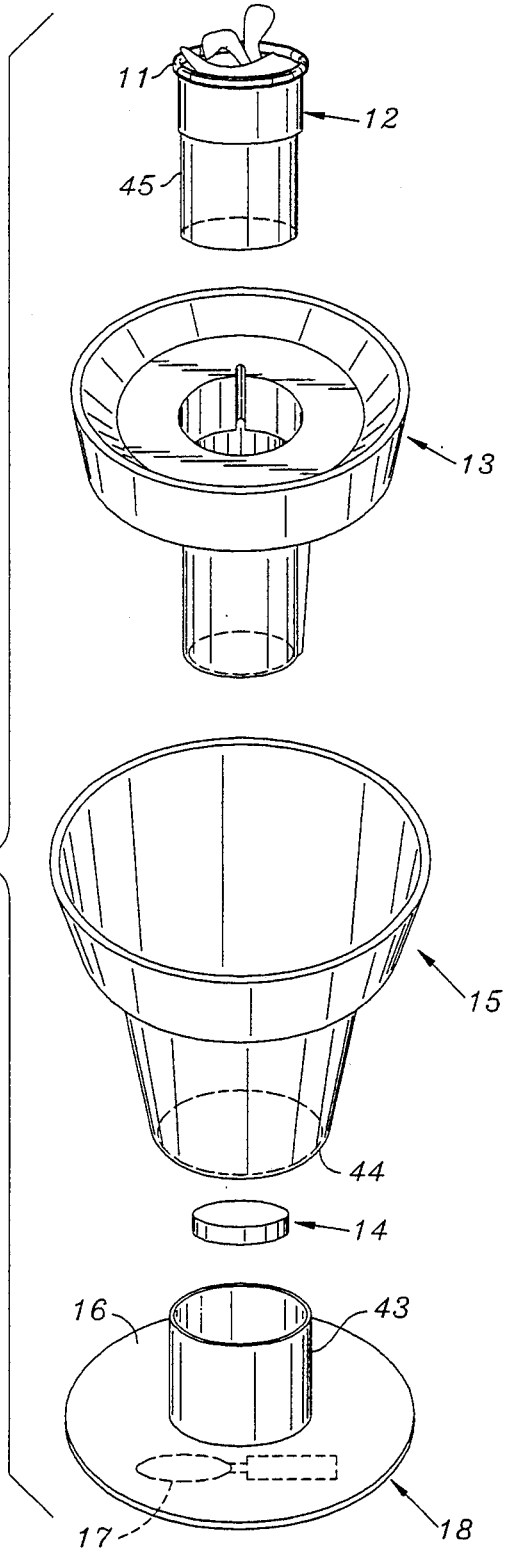

INFLATABLE NOVELTY DEVICE

RELATED APPLICATION

This application relates to U.S. application Ser. No. 29/005,844 entitled "Rubber Tree" and filed Mar. 12, 1993. This application is a continuation in part of this prior application, and the contents thereof are incorporated by reference herein.

BACKGROUND

Having a humorous and clever novelty device is highly desirable.

This invention relates to an inflatable device. In particular, it relates to a device which includes an inflatable element which is normally hidden from view. It is normally unknowingly or surprisingly inflated by user taking certain actions which actions are relatively far removed from the possibility of an action being related to inflating an element such as a balloon or condom.

Many novelty devices are known which are humorous in their application. Such devices may relate to the effect of an inflated balloon. In the Applicant's knowledge, however, novelty devices are not known which relate to an unsuspected inflation of a balloon.

There is a need to have such an improved novelty device.

SUMMARY

By the present invention there is provided a novelty device directed to meeting the above requirements.

According to the invention, there is provided a device for inflating an inflatable element such as a balloon. The element was a mouth through which pressure can be applied to the interior of the element. The device includes a nipple for receiving the mouth of the element.

There is a chamber for generating a pressure to be applied to the nipple, and the nipple is in communication with the chamber. The chamber is connected with a passage for receiving a fluid. There is also means for receiving a fluid reactive element such that, on application of fluid a pressure develops in the chamber. The pressure is released through the nipple such that when the mouth of the inflatable element is affixed to the nipple, the inflatable element is extendable under the pressure.

In a preferred form of the invention the chamber is formed by two mating elements, the elements being relatively movable and separable thereby to permit placement and periodic replacement of a reactive member in the chamber. The elements preferably include a first cylindrical element of a first diameter and a second cylindrical element of a smaller diameter so that it fits within the first cylindrical element.

A passage is formed between the cylindrical elements so that fluid can enter from the top of the cylinders and contact the reactive element located towards the bottom of the cylindrical elements.

In a further preferred form of the invention there is provided a transmitter in proximity with a wall of the chamber. The transmitter includes a switch, a battery, and a memory for a recorded melody or message. Fluid passing through the passage or in the chamber activates the switch by a short circuit such that the melody and/or message is played. This is affected substantially simultaneously with the fluid reacting with the reactive element such that the inflatable element extends above the nipple under the pressure.

In a preferred form of the invention, there is a removable cover located over the nipple. As such, before the inflatable element is inflated the inflatable element is essentially hidden from view. The inflatable element passes through the cover when the pressure is developed.

In the preferred aspect of the invention when water, as a fluid passes through the cover which is porous, and reacts with the reactive element which is sodium bicarbonate, the pressure causes the inflatable element to expand in a growing act about the porous cover. Simultaneously the water short circuits the switch of the transmitter and a selective melody or message is played.

The invention is further described with reference to the accompanying drawings.

DRAWINGS

FIG. 4 is a cross-sectional view of a second embodiment of the device.

FIG. 5 is an exploded perspective view of the second embodiment of the device.

DESCRIPTION

Figure 1:
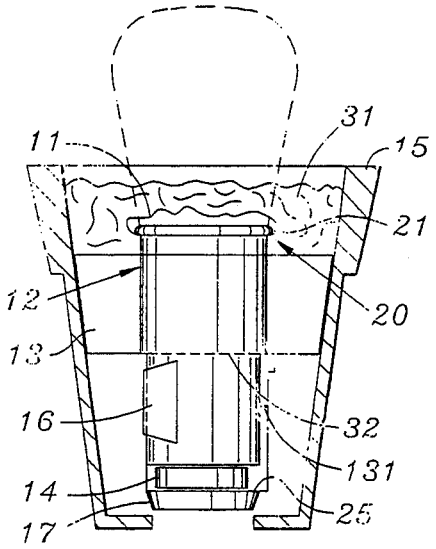
FIG. 1 is a cross-sectional view of a first embodiment of the device.
Figure 2:
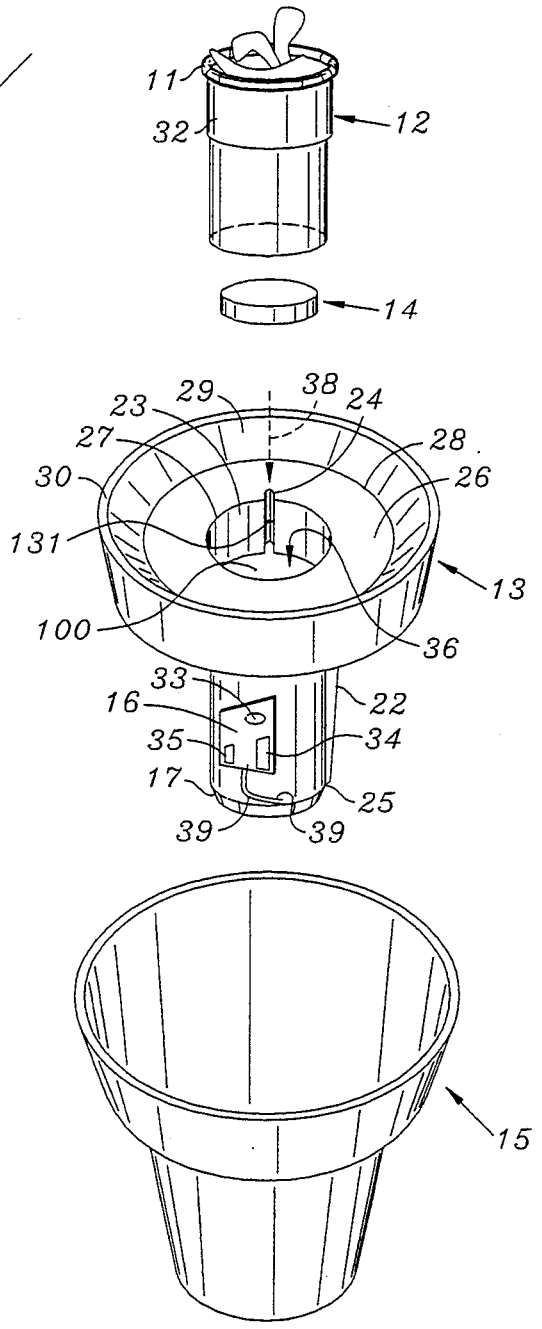
FIG. 2 is a perspective exploded view of the device.
Figure 3:
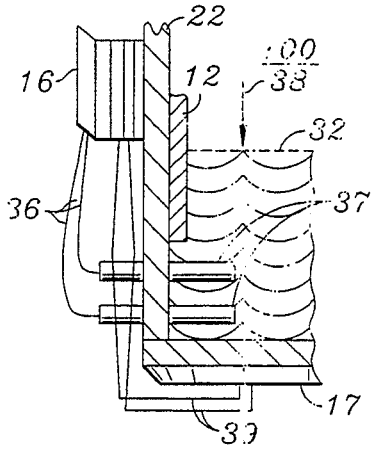
FIG. 3 is a cross-sectional partial view of the transmitter in relation to the second cylinder.

A device for inflating an inflatable element such as a balloon, latex balloon, Mylar (Trademark) balloon or condom is provided. The device has means to apply pressure to a mouth 20 of the balloon 11.

The device includes a first plastic cylinder element 12 which provides a circumferential nipple 21 about which the mouth 20 of the balloon 11 is located. The circumferential nipple 21 is a rim extending radially outwardly about the outside of the first plastic cylinder 12.

A second plastic cylinder element 22 is provided for mating relationship with the first cylinder 12. Cylinder 22 has a diameter which is relatively larger than the diameter for the first plastic cylinder 12. As such the cylinder 12 can be moved within or from the bore of the first cylinder 22. A chamber 100 is formed inside the first cylinder 12 as surrounded by the second cylinder 22 with its base 25.

Located on the inside wall 23 of the second cylinder 22 is a groove or passage 24 which permits fluid to pass downwardly towards the base 25 of the first cylinder 12.

Located towards the base 25 of the first cylinder 12 is an effervescent tablet or effervescent powder 14, namely sodium bicarbonate. Such tablet is commonly known as Alka Seltzer (Trademark of Miles, Inc. of Elkhart, Ind.). One such tablet contains about 1 gram of sodium bicarbonate. Such an effervescent compound is reactive to a fluid, such as water, such that a pressure develops as the compound effervesces. The tablet 14 is effectively located within the first cylinder 12 and may extend at least partly inside the second cylinder 22. The tablet rests on the base 25. The increased pressure causes pressure to be applied to the balloon 11 which is caused to inflate under the increased pressure.

The second cylinder 22 includes a rim 26 circumferentially arranged about the top 27 of the second cylinder. Directed from the outer periphery 28 of the rim 27 is an upwardly sloping top member 29 directed to an outer circumferential rim 30. The upwardly sloping wall 29 and base 26 acts to form a cup to receive a porous covering element 31 which is in the form of artificial moss. As such the moss 31 does not inhibit the inflation of the inflatable element 11 as illustrated in phantom line 111. When the balloon 11 expands under the increased pressure action from the effervescing tablet 14.

The first cylinder 12 and second cylinder 22 are locatable within a retaining pot 15 which is in the form of a plant pot or flower pot or other ornamental container. As such when the device is assembled with the first cylinder and second cylinder with the retaining pot 15 and moss 31 in location in the cup formed on top of the second cylinder, there is the appearance of a pot plant without a plant or flower.

The addition of water to the second cylinder 22 and into passage 24 to the effervescent tablet 14 causes the balloon to 11 rise above the porous material 31 into its inflated state 111.

To facilitate the maintenance of the increased pressure within the chamber 100, a one way valve 131 is provided in the passage 24. The valve 131 is in the form of a flexible element which is biased against upward movement. Thus the effect of water pressing down on the valve 131 in passage 24 causes water to enter the passage 24 and the chamber 100 within which is contained the effervescent tablet 14. The valve 131 is located so as to substantially close the passage 24.

In a different form of the invention, without the valve 131 the effective water head 32 in the chamber 100 prevents the increased pressure above the line 32 from causing the water to be forced downwardly, outwardly, and upwardly through passage 24 in reverse to the direction of fluid inlet through passage 24. The head pressure should be at least sufficient to prevent the reverse flow of water to an extent that the balloon 11 can be retained in it's expanded state 111. The determination of the amount of water would vary according to the elasticity of the balloon or condom. The Mylar balloon would not have much elasticity and thus there would be less force to counteract the increased pressure from the reaction.

A further feature of the characteristics of the first cylinder 12 and second cylinder 22 is that at least one of the elements is relatively tapered relative to the other. Preferably both elements 12 and 22 are tapered such that when the first cylinder 12 is inserted into the second cylinder 22 a locking action is affected between the outer wall 32 of the first cylinder and the inner wall 23 of the second cylinder. This acts to assist formation of an effective chamber 100.

An additional characteristic of the novelty device is achieved by a transmitter 16 which communicates a predetermined signal. Such signal could be a digitally prerecorded melody and/or prerecorded voice message or a recordable melody and/or recordable message. The transmitter has a music module, and is a device produced by Allegro Electronics, part number A3, of Fremont, Calif. U.S.A. Such device 16 includes a battery 33, a memory chip 34 for receiving, recording and outputting predetermined signals and a speaker 17 for transmitting the signals.

There is also a switch 35 which is connected to conductors 36 with terminals 37 which project inside the wall 22 of the second cylinder 22, namely into the chamber 100. Thus when water is poured through passage 24 it passes downwardly as indicated by arrow 38. A short circuit is effected between the terminal pins 37 which closes switch 35 to activate the memory 34. The message signals are transmitted along conductors 39 to the music module speaker 17.

With this novelty device, when water is added it passes through cover 31 and enters the passage 24 and short circuit terminals 37. A melody or message is then transmitted through speaker 17. Substantially simultaneously the effervescent tablet 14 is activated to increase pressure. This acts on the inflatable balloon 11 to cause the balloon 11 to rise and project through the movable covering 31. An effective novelty device is obtained whereby the addition of water to the flower pot acts to cause an inflatable element, normally hidden from view below cover 31, to become inflatable and rise above cover 31.

In the embodiment illustrated in FIGS. 4 and 5 there is a tray or receptacle table 18 located below a base 40 for the plant pot 15. The base 18 mounts the transmitter 16 and speaker 17 below a platform 41 of the tray 18. Legs 42 are provided to the tray 18 to elevate the platform 41. The terminal pins 37 project through the base 41 into the chamber 100 containing the effervescent tablet 14.

In this embodiment the base 18 includes an upstanding cylinder 43 in which the effervescent tablet 14 is located. The cylinder 43 projects through an aperture 44 in the base of the plant pot 15. The cylinder 43 also engages with the first cylinder 12. As such cylinder 43 is a first component of the cylinder 12. There is a second component 45 which depends from the first cylinder such that the components 43 and 45 collectively constitute a first cylinder 12. The component 43 fits within the depending component portion of 45 of the first cylinder 12. In this manner there are three cylindrical components 43, 45 and cylinder 22 which together with a pot of base 18 form the chambers 100.

General

Many other forms of the invention exist each differing from others in matters of detail only.

Different inflatable elements can be applied to the mouth of the nipple. Likewise a different retainer device 15 may be used to surround the chamber in a suitable manner to provide an effective novelty device. Different coverings can be provided to the inflatable member. Thus instead of artificial moss, granulated materials such as plastic pebbles or other elements can be placed over the nipple for holding the inflated element in a non-inflated position. Such pebbles could effectively hide the uninflatable balloon from view until pressurized. With the device it is easily to possible to replace effervescent elements and the inflatable elements as often as necessary to repetitively use the novelty device.

In other situations, different chemicals can be used to create the pressure in the chamber. Thus, instead of an effervescent compound sodium bicarbonate, other different suitable products could be used to react with the fluid being input to create the increased pressure. The effervescent material can be in a powder form, tablet or other form. Different reactive compounds can be suitably placed and replaced in the chamber as required.

The invention is to be considered solely in terms of the following claims.

I claim:

1. A fluid responsive device for inflating an inflatable element having a mouth through which pressure can be applied to an interior of the element the device comprising, a chamber for generating a pressure to be applied to a nipple, such nipple being in communication with the chamber, a passage for receiving a fluid and communicating the fluid to the chamber, means for receiving a fluid reactive element in the chamber such that on application of a fluid a pressure develops in the chamber, the pressure being releasable through the nipple such that when the mouth of an inflatable element is affixed to the nipple, the inflatable element is extendable under the pressure, and sound reproduction means mounted upon said device with activation means in communication with said chamber being activated by received fluid, said sound reproduction means including a memory means containing a predetermined signal, and a transducer in electronic communication with said memory means for transmitting such predetermined signal.

2. A device as claimed in claim 1 wherein the chamber is formed by two mating elements, the elements being relatively moveable thereby to permit replacement of a reactive element in the chamber.

3. A device as claimed in claim 1 wherein the chamber is formed by two cylindrical elements, a first cylindrical element being of a relatively smaller diameter than a second cylindrical element and the passage being defined at least in part between the first cylindrical element and the second cylindrical element.

4. A device as claimed in claim 3 wherein the passage is formed in an inner wall of the second cylindrical element.

5. A device as claimed in claim 4 wherein the second cylindrical element includes a base, and wherein the first element is located above the base of the second element and the means for locating the reactive element being located on the base, and wherein the pressure is communicated to the interior of the first cylindrical element and to an inflatable element located on the first cylindrical element, the nipple being located on a rim of the first cylindrical element.

6. A device as claimed in claim 2 wherein the first cylindrical element includes two relatively telescoping cylindrical components, a first component being located above a second component, and the second component being affixed to a base such that the first component of the first cylindrical element fits with the second component of the first cylindrical element thereby to complete the assembly of the first cylindrical element, and wherein the second cylindrical element fits about the first cylindrical component.

7. A device as claimed in claim 6 including means for locating the reactive element adjacent the base of the second component of the first cylindrical element, the reactive element being within the first cylindrical element.

8. A device as claimed in claim 1 wherein the sound reproduction means is in proximity with a wall of the chamber, the sound reproduction means includes a switch and a battery.

9. A device as claimed in claim 8 wherein the predetermined signal represents a digitally prerecorded melody.

10. A device as claimed in claim 8 wherein the predetermined signal represents a digitally prerecorded message.

11. A device as claimed in claim 8 wherein the predetermined signal represents a digitally recordable melody.

12. A device as claimed in claim 8 wherein the predetermined signals represents a digitally recordable message.

13. A device as claimed in claim 8 wherein the switch includes terminal means activated by a circuit closure, the circuit closure being affected by the addition of a predetermined amount of fluid through the passage into the chamber, and wherein after closure the memory is activated to transmit signals through the speaker.

14. A device as claimed in claim 1 wherein the inflatable element is selectively at least one or more of a balloon or condom.

15. A device as claimed in claim 3 wherein the first cylindrical element fits within the second cylindrical element such that there is a space between the elements, the space defining at least part of the passage, and wherein the second cylindrical element includes a rim, the rim being arranged about a top of the cylindrical element, and the rim being for receiving removable imitation vegetation, the removal of the vegetation being effected to provide access to the first cylinder.

16. A device as claimed in claim 1 including a valve for the passage thereby to inhibit increased pressure escaping from the passage.

17. A device as claimed in claim 1 wherein the reactive element is selectively a tablet or a powder.

18. A device as claimed in claim 17 wherein the reactive element is an effervescent compound, effervescence being under the reaction of the fluid, such fluid being selectively water and the compound being selectively sodium bicarbonate.

19. A device as claimed in claim 1 including a removable cover for the nipple and the inflatable element prior to inflation.

20. A device as claimed in claim 19 wherein the cover is at least partly removable under the action of the inflating element.

21. A device as claimed in claim 20 wherein the fluid is passable through the cover prior to the cover being removed by the inflating element.

22. A device as claimed in claim 1 wherein the nipple and chamber are contained within a retainer pot.

23. A fluid responsive device for inflating an inflatable element having a mouth through which pressure can be applied to the interior of the element, the device comprising a chamber for generating a pressure to be applied to a nipple, such nipple being in the communication with the chamber, a passage for receiving a fluid and communicating the fluid to the chamber, means for receiving a fluid reactive element in the chamber such that on application of a fluid a pressure develops in the chamber, the pressure being releasable through the nipple such that when the mouth of an inflatable element is affixed to the nipple, the inflatable element is extended under pressure, a removable cover for the nipple and an inflatable element prior to an inflation, and sound reproduction means mounted in proximity with a wall of an chamber, the sound reproduction means including a fluid responsive switch means in communication with said chamber, a battery, a memory containing a predetermined signal, and a speaker for transmitting such predetermined signal.

24. A device as claimed in claim 23 wherein the switch includes terminals and means activated by a circuit closure, the circuit closure being affected by the addition of a predetermined amount of fluid through the passage into the chamber, and wherein after closure the memory is activated to transmit signals through the speaker.

25. A device as claimed in claim 23 wherein the cover is at least partly removable under the action of the inflating element, the fluid being passable through the cover prior to the cover being removed by the inflating element, and wherein the nipple and chamber are contained within a retainer pot.

* * * * *